US011268330B2

(12) United States Patent
Al-Mousa et al.

(10) Patent No.: US 11,268,330 B2
(45) Date of Patent: Mar. 8, 2022

(54) WIRED SWIVEL IN WELLBORE DRILLING

(71) Applicant: Saudi Arabian Oil Company, Dhahran (SA)

(72) Inventors: Ahmed Al-Mousa, Dhahran (SA); Ahmed A. Al-Ramadhan, Dammam (SA); Qadir Looni, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 6 days.

(21) Appl. No.: 16/800,516

(22) Filed: Feb. 25, 2020

(65) Prior Publication Data

US 2021/0262296 A1 Aug. 26, 2021

(51) Int. Cl.

| | |
|---|---|
| ***E21B 17/02*** | (2006.01) |
| ***E21B 17/05*** | (2006.01) |
| ***E21B 47/12*** | (2012.01) |
| ***E21B 17/046*** | (2006.01) |

(52) U.S. Cl.
CPC ..... *E21B 17/028* (2013.01); *E21B 17/0465* (2020.05); *E21B 17/05* (2013.01); *E21B 47/12* (2013.01)

(58) Field of Classification Search
CPC ..... E21B 17/028; E21B 17/05; E21B 47/12; E21B 17/003; E21B 17/04; E21B 23/14; E21B 23/08; E21B 33/072
See application file for complete search history.

(56) References Cited

U.S. PATENT DOCUMENTS

| | | | | |
|---|---|---|---|---|
| 5,468,153 | A | 11/1995 | Brown et al. | |
| 5,996,712 | A | 12/1999 | Boyd | |
| 6,247,542 | B1 | 6/2001 | Kruspe et al. | |
| 10,301,989 | B2 | 5/2019 | Imada | |
| 2008/0236841 | A1 | 10/2008 | Howlett et al. | |
| 2014/0090898 | A1* | 4/2014 | Moriarty | E21B 7/20 175/78 |
| 2018/0175545 | A1 | 6/2018 | Engel et al. | |
| 2019/0316424 | A1 | 10/2019 | Robichaux et al. | |

FOREIGN PATENT DOCUMENTS

| | | |
|---|---|---|
| AU | 2007249417 | 11/2007 |
| EP | 2737172 | 6/2014 |
| GB | 2425138 | 10/2006 |
| GB | 2546996 | 8/2017 |

OTHER PUBLICATIONS

PCT International Search Report and Written Opinion in International Appln. No. PCT/US2021/019419, dated May 31, 2021, 15 pages.

* cited by examiner

*Primary Examiner* — Tara Schimpf
(74) *Attorney, Agent, or Firm* — Fish & Richardson P.C.

(57) ABSTRACT

A swivel includes a male segment, a female segment, and a lock pin. The male segment can mate with the female segment, and the lock pin can pass through the female segment and engage with the male segment to prevent relative axial movement of the male segment and the female segment while allowing relative rotational movement of the male segment and the female segment. The male segment includes a first conductive ring configured to couple to a first wire. The female segment includes a second conductive ring configured to couple to a second wire. Contact between the first and second conductive rings establishes an electrical connection between the first and second wires.

19 Claims, 6 Drawing Sheets

WIRED SWIVEL IN WELLBORE DRILLING

TECHNICAL FIELD

This disclosure relates to drilling in subterranean formations.

BACKGROUND

Well logging includes development of a detailed record of geologic formations penetrated by a borehole. Some types of well logs can be obtained during any phase of a well's history, such as during drilling, completion, production, or abandonment. One or more instruments positioned within a wellbore can collect well logging data. The data can either be transmitted to the surface (for example, in real-time) or be saved locally on the instrument and subsequently recorded after the instrument has been retrieved from the wellbore.

SUMMARY

This disclosure describes technologies relating to a wired swivel for use in wellbore drilling. Certain aspects of the subject matter described can be implemented as a swivel. The swivel includes a male segment, a female segment, and a lock pin. The male segment is configured to couple to a first drill pipe of a drill string that is configured to form a wellbore in a subterranean formation. The male segment includes an outer circumferential surface and a first conductive ring. The outer circumferential surface defines a groove. The first conductive ring is disposed on the outer circumferential surface. The first conductive ring is configured to couple to a first wire disposed within the first drill pipe. The female segment is configured to couple to a second drill pipe of the drill string. The female segment defines a passageway. The female segment includes an inner circumferential surface and a second conductive ring. The inner circumferential surface is configured to mate with the outer circumferential surface of the male segment. The second conductive ring is disposed on the inner circumferential surface of the female segment. The second conductive ring is configured to couple to a second wire disposed within the second drill pipe. The second conductive ring is configured to contact the first conductive ring when the inner circumferential surface of the female segment mates with the outer circumferential surface of the male segment to establish an electrical connection between the first wire and the second wire. The lock pin is configured to pass through the passageway of the female segment and engage with the groove of the male segment to prevent relative axial movement of the male segment and the female segment while allowing relative rotational movement of the male segment and the female segment.

This, and other aspects, can include one or more of the following features.

The swivel can include a first seal and a second seal positioned between the male segment and the female segment. The first seal, the second seal, the outer circumferential surface of the male segment, and the inner circumferential surface of the female segment can together define an inner volume between the male segment and the female segment.

The first conductive ring and the second conductive ring can be axially positioned, relative to a longitudinal axis of the swivel, between the first seal and the second seal, such that the first conductive ring and the second conductive ring are electrically isolated from a remaining portion of the swivel and fluidically isolated from fluids external to the inner volume.

The first conductive ring can be rotationally fixed relative to the male segment. The second conductive ring can be rotationally fixed relative to the female segment. The first conductive ring and the second conductive ring can be configured to maintain the electrical connection between the first wire and the second wire during relative rotational movement of the first conductive ring and the second conductive ring.

The lock pin and the passageway of the female segment can be threaded.

Each of the first seal and the second seal can include a self-lubricated O-ring.

Certain aspects of the subject matter described can be implemented as a system. The system includes a first drill pipe configured to be disposed within a subterranean formation. The system includes a first wire configured to be disposed within the first drill pipe. The system includes a second drill pipe configured to be disposed within the subterranean formation. The system includes a second wire configured to be disposed within the second drill pipe. The system includes a swivel connecting the first drill pipe to the second drill pipe and the first wire to the second wire. The swivel includes a male segment, a female segment, and a lock pin. The male segment is connected to the first drill pipe. The female segment is connected to the second drill pipe. The male segment and the female segment are configured to mate with each other to establish an electrical connection between the first wire and the second wire. The lock pin is configured to prevent relative axial movement of the male segment and the female segment while allowing relative rotational movement of the male segment and the female segment.

This, and other aspects, can include one or more of the following features.

The male segment can include an outer circumferential surface that defines a groove. The female segment can include an inner circumferential surface. The female segment can define a passageway. The lock pin can be configured to pass through the passageway of the female segment and engage with the groove of the male segment.

The lock pin and the passageway of the female segment can be threaded.

The male segment can include a first conductive ring that is connected to the first wire. The female segment can include a second conductive ring that is connected to the second wire. The first conductive ring of the male segment can be configured to contact the second conductive ring of the female segment when the male segment and the female segment mate with each other to establish the electrical connection between the first wire and the second wire.

The first conductive ring can be rotationally fixed relative to the male segment. The second conductive ring can be rotationally fixed relative to the female segment. The first conductive ring and the second conductive ring can be configured to maintain the electrical connection between the first wire and the second wire during relative rotational movement of the first conductive ring and the second conductive ring.

The swivel can include a first seal and a second seal positioned between the male segment and the female segment. The first seal, the second seal, the male segment, and the female segment can together define an inner volume between the male segment and the female segment.

The first conductive ring and the second conductive ring can be axially positioned, relative to a longitudinal axis of the swivel, between the first seal and the second seal, such that the first conductive ring and the second conductive ring are electrically isolated from a remaining portion of the swivel and fluidically isolated from fluids external to the inner volume.

Each of the first seal and the second seal can include a self-lubricated O-ring.

At least one of the first seal or the second seal can be disposed on an axial surface of the male segment.

Certain aspects of the subject matter described can be implemented as a method. A first drill pipe is connected to a second drill pipe by a swivel. Relative rotational movement of the first drill pipe and the second drill pipe is enabled by the swivel while relative axial movement of the first drill pipe and the second drill pipe is prevented by the swivel. An electrical connection between a first wire disposed within the first drill pipe and a second wire disposed within the second drill pipe is established by the swivel.

This, and other aspects, can include one or more of the following features.

The swivel can include a first portion that is connected to the first drill pipe. The first portion can define a groove. The swivel can include a second portion that is connected to the second drill pipe. The second portion can be mated with the first portion. The second portion can define a passageway. Connecting the first drill pipe to the second drill pipe can include passing the lock pin through the passageway of the second portion and engaging the lock pin with the groove of the first portion to secure the first portion to the second portion. Engaging the lock pin with the groove of the first portion can prevent the relative axial movement of the first drill pipe and the second drill pipe.

The first portion can include a first conductive ring that is connected to the first wire. The second portion can include a second conductive ring that is connected to the second wire. Establishing the electrical connection between the first wire and the second wire can include establishing contact between the first conductive ring and the second conductive ring.

The first conductive ring can be rotationally fixed to the first portion. The second conductive ring can be rotationally fixed to the second portion. The method can include continuously contacting the first conductive ring to the second conductive ring during relative rotational movement of the first conductive ring and the second conductive ring to maintain the electrical connection between the first wire and the second wire.

The swivel can include a first seal and a second seal positioned between the first portion and the second portion. The first seal, the second seal, the first portion, and the second portion can define an inner volume between the first portion and the second portion. The method can include isolating, by the first seal and the second seal, the first conductive ring and the second conductive ring within the inner volume.

The details of one or more implementations of the subject matter of this disclosure are set forth in the accompanying drawings and the description. Other features, aspects, and advantages of the subject matter will become apparent from the description, the drawings, and the claims.

DETAILED DESCRIPTION

This disclosure relates to drilling in preparation of well installation. Wellbore drilling involves rotating a drill string with a drill bit attached in order to cut into a subterranean formation. Logging or sampling operations can be carried out by one or more tools located within the wellbore. In some cases, logging or sampling data can be transmitted to the surface during the logging or sampling operations. In other cases, logging or sampling data can be downloaded from the one or more tools after they have been retrieved from the wellbore. Logging or sampling operations while keeping the drill string stationary (non-rotating) can have increased risk of differential sticking, which can result in expensive (both in capital costs and time loss) fishing operations, loss of drilled sections, or both.

The swivel described in this disclosure can be used, for example, in drilling operations. The subject matter described in this disclosure can be implemented in particular implementations, so as to realize one or more of the following advantages. The swivel can allow for relative rotational movement between components of a drill string. In this disclosure, "relative rotational movement" between two components means the rotating rates of the two components are different from each other. For example, one of the components can be rotating (rotating rate is non-zero) while the other is non-rotating (rotating rate is zero). For example, both of the components can be rotating but at different rates, directions, or both. The swivel can be wired, such that energy, information, or both can be transferred through the swivel, even during relative rotational movement of components connected to the swivel. For example, logging data, sampling data, or both can be transmitted to the surface through the swivel while a portion of the swivel rotates while another portion of the swivel remains non-rotating. For example, drill string components uphole of the swivel can rotate while drill string components downhole of the swivel can remain non-rotating, and information can be transmitted from instruments downhole of the swivel up to the surface during this relative rotational movement. The rotation of drill string components can reduce the risk of differential sticking.

Figure 1:
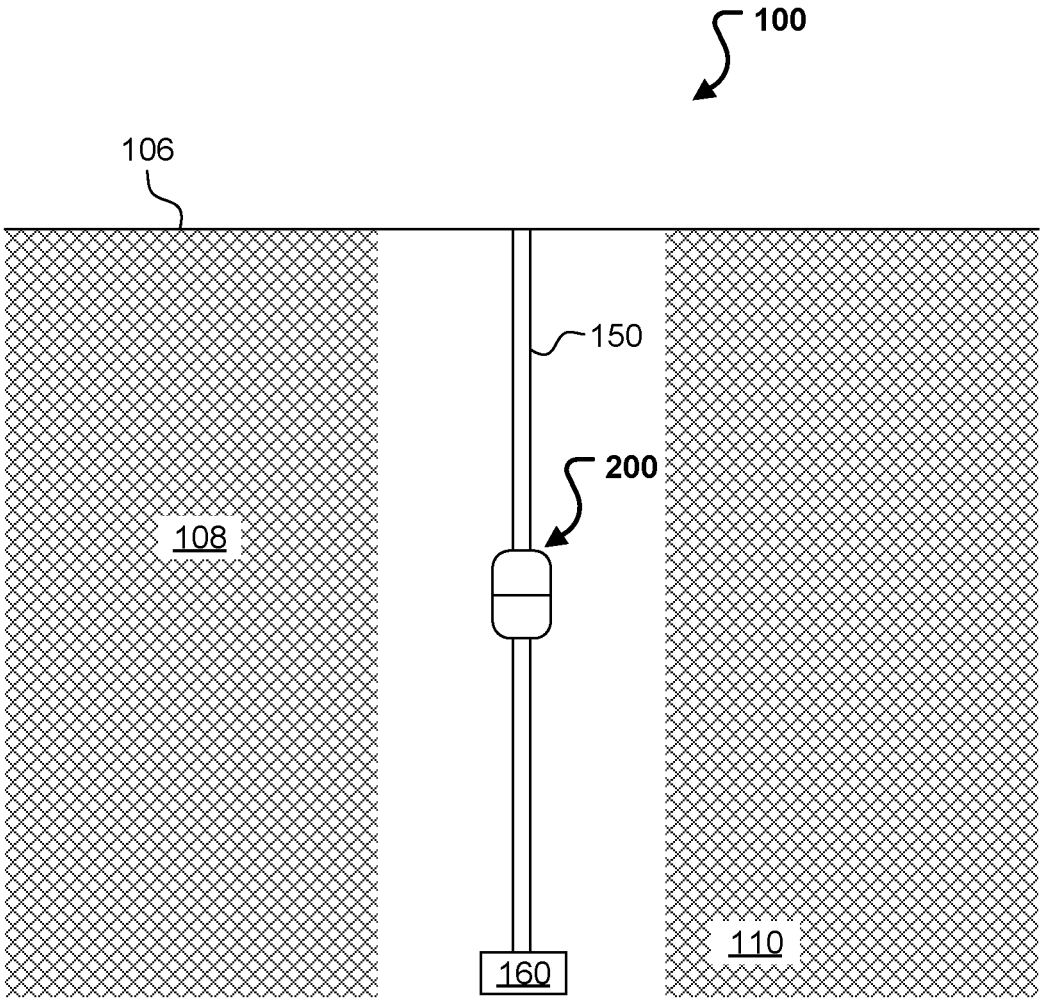
FIG. 1 is a schematic diagram of an example well.

FIG. 1 depicts an example wellbore 100 in accordance with the concepts herein. The wellbore 100 extends from the surface 106 through the Earth 108 to one more subterranean zones of interest 110 (one shown). The wellbore 100 enables access to the subterranean zones of interest 110 to allow recovery (that is, production) of fluids to the surface 106 (represented by flow arrows in FIG. 1) and, in some implementations, additionally or alternatively allows fluids to be placed in the Earth 108. In some implementations, the subterranean zone 110 is a formation within the Earth 108 defining a reservoir, but in other instances, the zone 110 can be multiple formations or a portion of a formation. The subterranean zone can include, for example, a formation, a portion of a formation, or multiple formations in a hydrocarbon-bearing reservoir from which recovery operations can be practiced to recover trapped hydrocarbons. In some implementations, the subterranean zone includes an underground formation of naturally fractured or porous rock containing hydrocarbons (for example, oil, gas, or both). In some implementations, the well can intersect other suitable types of formations, including reservoirs that are not naturally fractured. For simplicity's sake, the wellbore 100 shown is for a vertical well, but in other instances, the wellbore 100 can be for a deviated well with a wellbore 100 deviated from vertical (for example, horizontal or slanted), the wellbore 100 can include multiple bores forming a multilateral well (that is, a well having multiple lateral wells branching off another well or wells), or both.

In some implementations, the wellbore 100 is formed in preparation for a gas well that is used in producing hydrocarbon gas (such as natural gas) from the subterranean zones of interest 110 to the surface 106. While termed a "gas well," the well need not produce only dry gas, and may incidentally or in much smaller quantities, produce liquid including oil, water, or both.

In some implementations, the wellbore 100 is formed in preparation for an oil well that is used in producing hydrocarbon liquid (such as crude oil) from the subterranean zones of interest 110 to the surface 106. While termed an "oil well," the well not need produce only hydrocarbon liquid, and may incidentally or in much smaller quantities, produce gas, water, or both.

In some implementations, the production from the wellbore 100 can be multiphase in any ratio. In some implementations, the production from the wellbore 100 can produce mostly or entirely liquid at certain times and mostly or entirely gas at other times. For example, in certain types of wells it is common to produce water for a period of time to gain access to the gas in the subterranean zone. The concepts herein, though, are not limited in applicability to gas wells, oil wells, or even production wells, and could be used in wells for producing other gas or liquid resources or could be used in injection wells, disposal wells, or other types of wells used in placing fluids into the Earth.

The wellbore 100 is typically, although not necessarily, cylindrical. The wellbore 100 can be formed by drilling into the subterranean formation. For example, a drill string 150 can be used to form the wellbore 100 in the subterranean formation. The wellbore 100 can be lined with a tubing, such as a casing. One or more additional tubing can be disposed within the wellbore for fluid conveyance.

FIG. 1 shows a wired swivel 200 (also shown in FIG. 2 and described in more detail later) coupled to a drill string 150 that is disposed within the wellbore 100. An instrument 160 downhole of the swivel 200 can be connected through the drill string 150 and the swivel 200 to the surface, such that information from the instrument 160 can be transmitted to the surface. The instrument 160 can be, for example, a sampling tool or a logging tool. For example, a sampling tool can be used to sample formation fluid. For example, a logging tool can be used to measure formation pressure. The swivel 200 allows for relative rotational movement between the drill string 150 uphole of the swivel 200 (uphole portion of the drill string 150) and the drill string 150 downhole of the swivel 200 (downhole portion of the drill string 150). Components coupled to the uphole portion of the drill string 150 may be rotationally fixed to the uphole portion of the drill string 150. Components coupled to the downhole portion of the drill string 150 may be rotationally fixed to the downhole portion of the drill string 150. For example, components uphole of the swivel 200 can be rotated with the uphole portion of the drill string 150 while components downhole of the swivel 200 (such as instrument 160) remain non-rotating with the downhole portion of the drill string 150. Similarly, if desired, components downhole of the swivel 200 can be rotated with the downhole portion of the drill string 150 while components uphole of the swivel 200 remain non-rotating with the uphole portion of the drill string 150. The swivel 200 is wired in that components downhole and uphole of the swivel can be electrically connected to each other through the swivel 200, thereby allowing for transmittal of energy, information, or both through the swivel 200. The swivel 200 is configured to allow such transmittal to occur even during relative rotational movement of the uphole portion of the drill string 150 and the downhole portion of the drill string 150 with respect to each other.

Figure 2A:
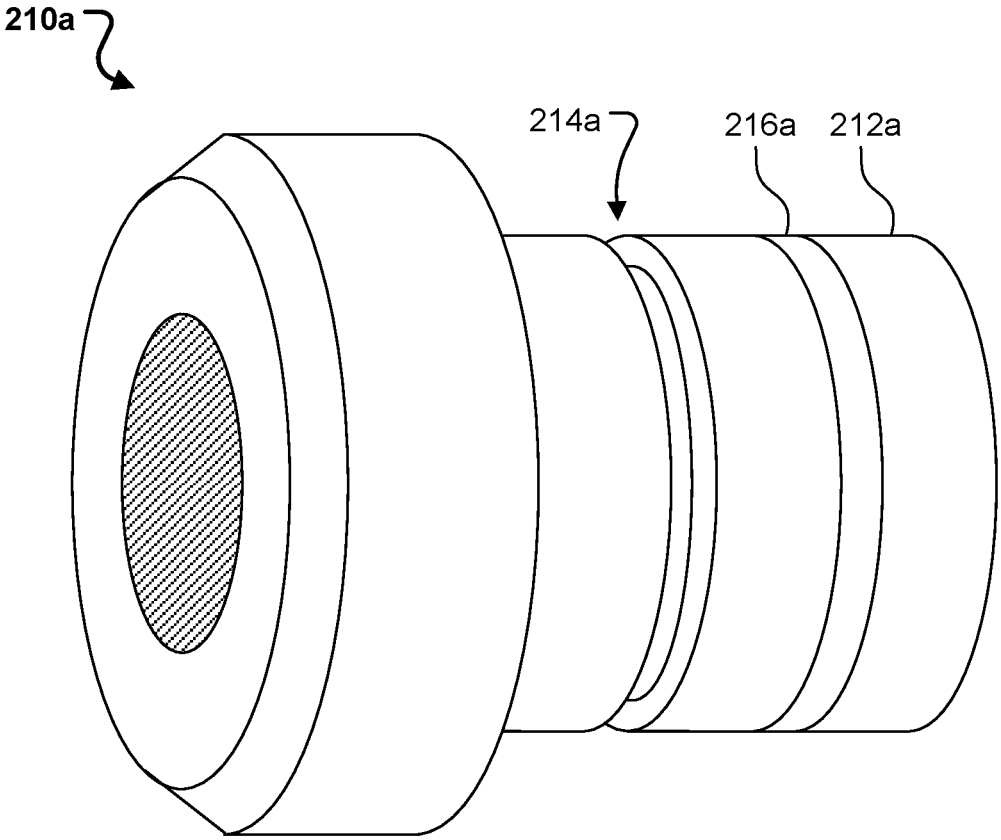
FIGS. 2A and 2B are schematic diagrams of portions of an example swivel.

FIG. 2A is a perspective view of a male segment 210*a* of the swivel 200. The male segment 210*a* includes an outer circumferential surface 212*a*. In some implementations, the outer circumferential surface 212*a* defines a groove 214*a* that can receive a pin (for example, a lock pin 218 shown in FIGS. 2C and 2D). The groove 214*a* can be, for example, an indention that forms a pathway along the outer circumferential surface 212*a*. In some implementations, the groove 214*a* spans the entirety of the outer circumferential surface 212*a*. The depth of the groove 214*a* can depend on various factors, such as the length of the pin that is received by the groove 214*a* and the desired depth at which the pin is received by the groove 214*a*. In some implementations, the groove 214*a* has a depth of at least 0.5 centimeter (cm), at least 1 cm, or at least 1.5 cm. In some implementations, the depth of the groove 214*a* with respect to the longitudinal axis of the male segment 210*a* is uniform. In some implementations, the depth of the groove 214*a* with respect to the longitudinal axis of the male segment 210*a* is not uniform. The variation (or non-variation) of the depth of the groove 214*a* with respect to the longitudinal axis of the male segment 210*a* can depend on the shape of the pin that is received by the groove 214*a*. For example, if the pin has a pointed end that is received by the groove 214*a*, the groove 214*a* can have a shape that corresponds with the pointed end of the pin. The width of the groove 214*a* can depend on various factors, such as the shape of the cross-sectional area of the pin that is received by the groove 214*a*. For example, the width of the groove 214*a* can match an outer diameter of the pin. In some implementations, the groove 214*a* has a width of at least 0.5 cm, at least 1 cm, or at least 1.5 cm.

The male segment 210*a* includes a first conductive ring 216*a* disposed on the outer circumferential surface 212*a*. The first conductive ring 216*a* is configured to couple to a wire disposed within the first drill pipe 150*a* (for example, a first wire 220*a* shown in FIG. 2D). A first end of the wire 220*a* can couple to the first conductive ring 216*a* while a second end of the wire 220*b* can couple to an instrument (for example, the instrument 160) or to a tool located at the surface 106. In some implementations, the first end of the wire 220*a* is welded to the first conductive ring 216*a*.

The first conductive ring 216*a* and the first wire 220*a* are electrically conductive, such that electricity running through the wire 220*a* can pass through the first conductive ring 216*a*. In some implementations, the first conductive ring 216*a* is made of a metal, such as copper, silver, or aluminum. In some implementations, the first wire 220*a* is made of a metal, such as copper, silver, or aluminum. In some implementations, the first conductive ring 216*a* is insulated. For example, the first conductive ring 216*a* can be surrounded by an electrical insulator such as rubber to electrically and fluidically isolate the first conductive ring 216*a* from a remaining portion of the swivel 200. In some implementations, the first wire 220*a* is insulated. For example, the first wire 220*a* can have a coating made of an electrical insulator such as rubber to electrically and fluidically isolate the first wire 220*a* from its external environment.

Figure 2B:
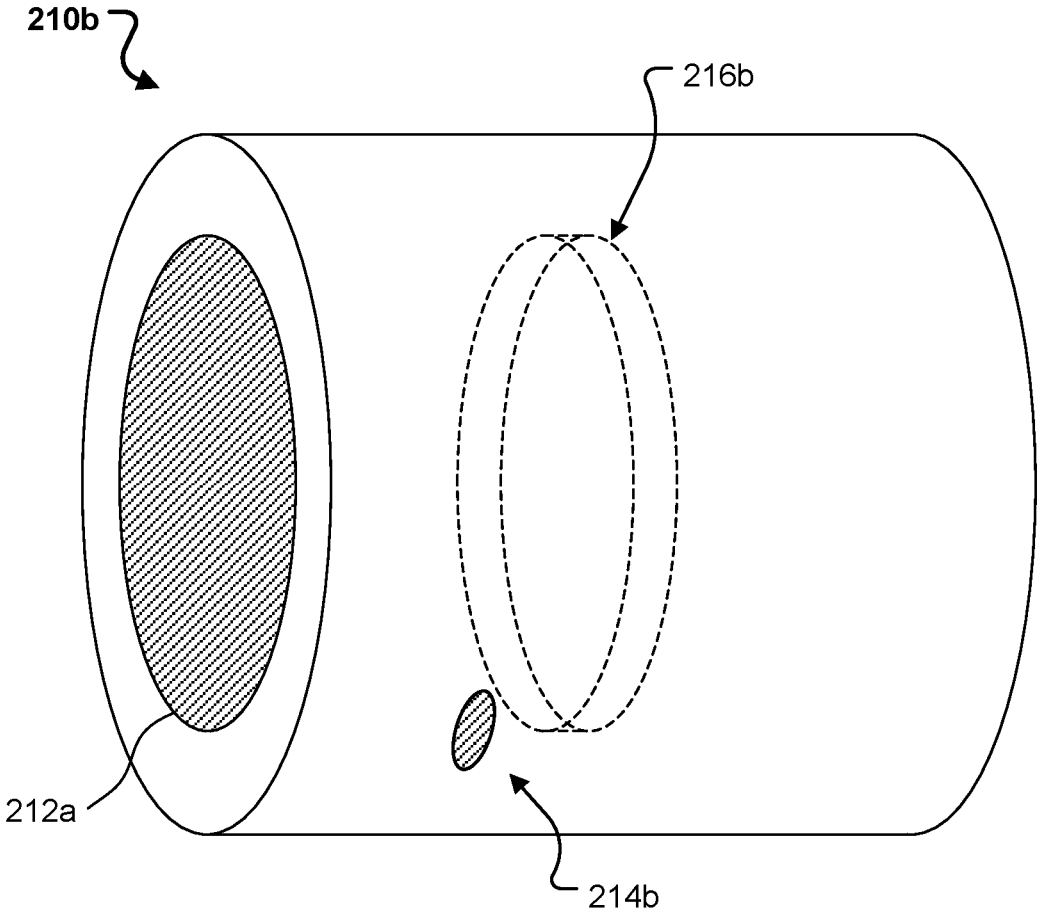

FIG. 2B is a perspective view of a female segment 210*b* of the swivel 200. The female segment 210*b* includes an inner circumferential surface 212*b*. The inner circumferential surface 212*b* is configured to mate with the outer circumferential surface 212*a* of the male segment 210*a*. In some implementations, the inner circumferential surface 212*b* defines a passageway 214*b* that a pin (for example, the lock pin 218 shown in FIGS. 2C and 2D) can pass through. The shape of the passageway 214*b* can depend on various factors, such as the shape of the pin that passes through the passageway 214*b*. In some implementations, the passageway 214*b* is a cylindrical bore. In implementations where the pin 218 is threaded, the passageway 214*b* is correspondingly threaded. In some implementations, the passageway 214*b* has a diameter of at least 0.5 cm, at least 1 cm, or at least 1.5 cm.

The female segment 210*b* includes a second conductive ring 216*b* disposed on the inner circumferential surface 212*b*. The second conductive ring 216*b* is configured to couple to a wire disposed within the second drill pipe 150*b* (for example, a second wire 220*b* shown in FIG. 2D). A first end of the wire 220*b* can couple to the second conductive ring 216*b* while a second end of the wire 220*b* can couple to an instrument (for example, the instrument 160) or to a tool located at the surface 106. In some implementations, the first end of the wire 220*b* is welded to the second conductive ring 216*b*.

The second conductive ring 216*b* and the second wire 220*b* are electrically conductive, such that electricity running through the wire 220*b* can pass through the second conductive ring 216*b*. In some implementations, the second conductive ring 216*b* is made of a metal, such as copper, silver, or aluminum. In some implementations, the second wire 220*b* is made of a metal, such as copper, silver, or aluminum. In some implementations, the second conductive ring 216*b* is insulated. For example, the second conductive ring 216*b* can be surrounded by an electrical insulator such as rubber to electrically and fluidically isolate the second conductive ring 216*b* from a remaining portion of the swivel 200. In some implementations, the second wire 220*b* is insulated. For example, the second wire 220*b* can have a coating made of an electrical insulator such as rubber to electrically and fluidically isolate the second wire 220*b* from its external environment.

Figure 2C:
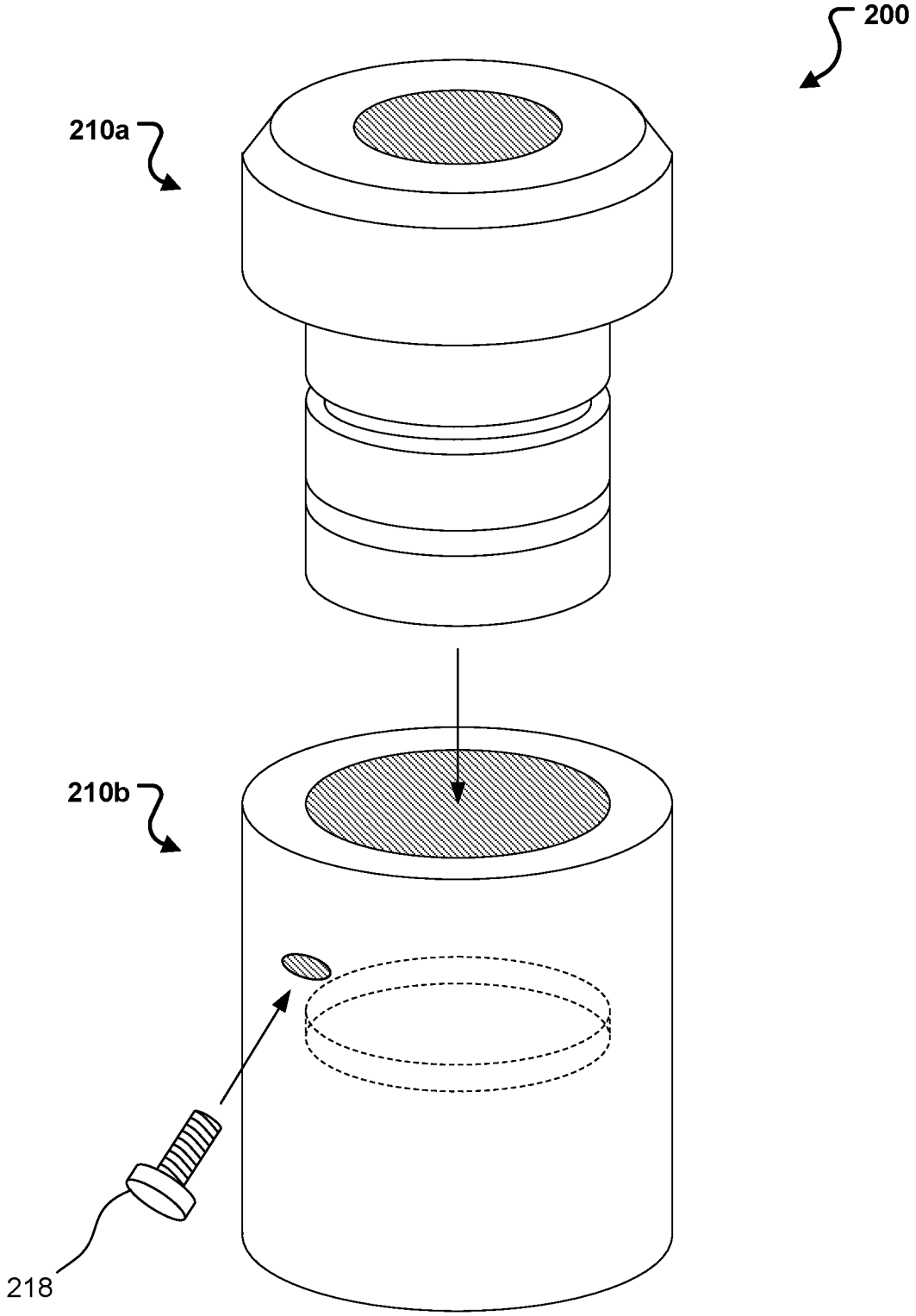
FIG. 2C is a schematic diagram of the portions of the example swivel being assembled together to form the wired swivel.

FIG. 2C is a perspective view of the male segment 210*a* and the female segment 210*b* of the swivel 200 being mated together. As shown, at least a portion of the male segment 210*a* can be inserted into the female segment 210*b*. The diameter of the outer circumferential surface 212*a* of the male segment 210*a* and the diameter of the inner circumferential surface 212*b* of the female segment 210*b* allow for the male segment 210*a* and the female segment 210*b* to mate with each other.

The male segment 210*a* and the female segment 210*b* are secured to each other by the lock pin 218. The lock pin 218 passes through the passageway 214*b* and engages with the groove 214*a* to secure the male segment 210*a* and the female segment 210*b* together. In implementations where the groove 214*a* spans the entirety of the outer circumferential surface 212*a* of the male segment 210*a*, relative rotational movement of the male segment 210*a* and the female segment 210*b* is unrestricted.

Figure 2D:
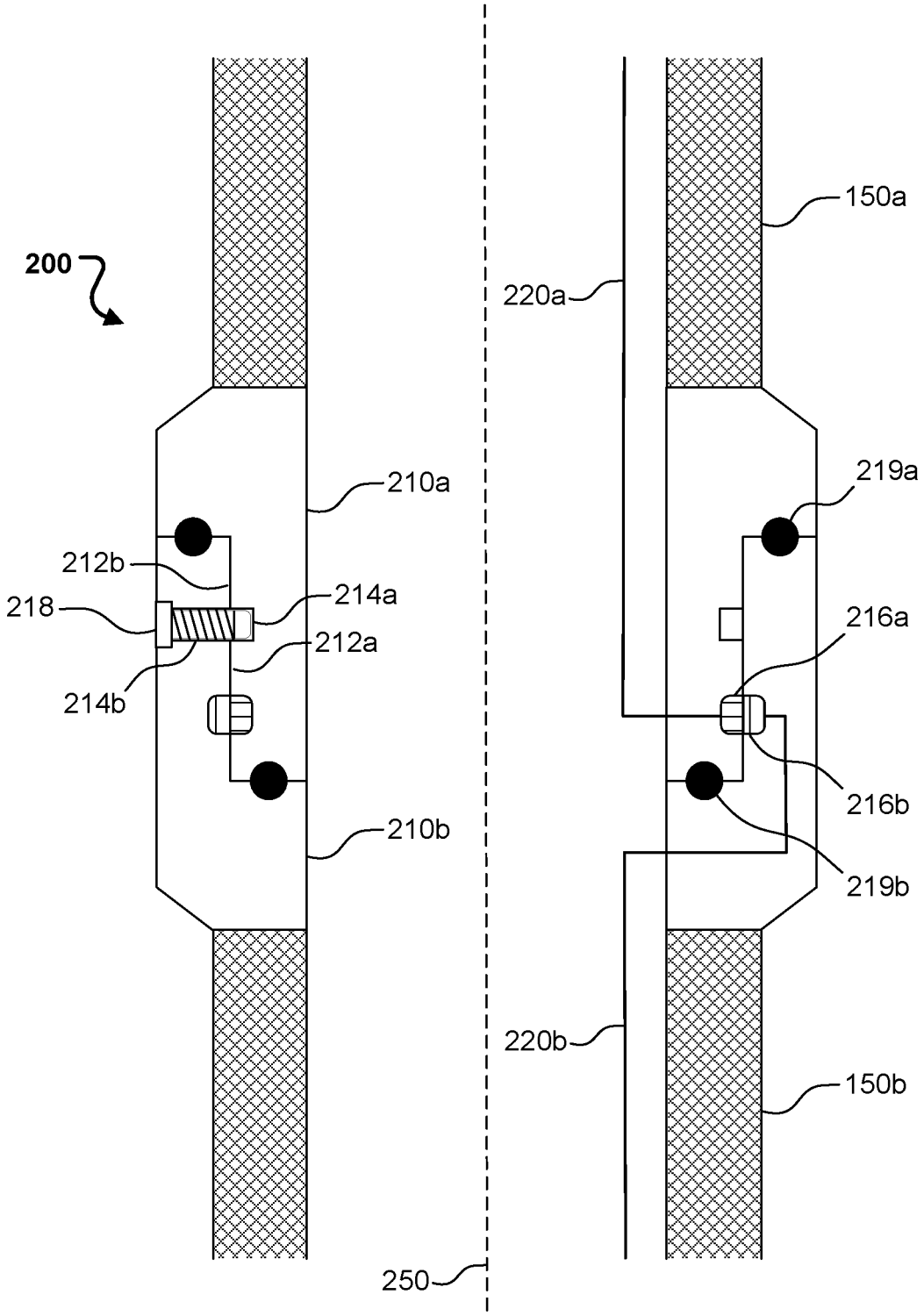
FIG. 2D is a cross-sectional view of the example swivel.

FIG. 2D is a cross-sectional view of an example of the swivel 200 through its longitudinal axis 250. The male segment 210*a* and the female segment 210*b* are mated with one another. The male segment 210*a* is configured to couple to a first drill pipe 150*a* of a drill string (for example, the drill string 150). The female segment 210*b* is configured to couple to a second drill pipe 150*b* of the drill string 150. The male segment 210*a* and the female segment 210*b* can couple to the first drill pipe 150*a* and the second drill pipe 150*b*, respectively, for example, by a threaded connection or a welded connection.

The position of the first conductive ring 216*a* on the male segment 210*a* and the position of the second conductive ring 216*b* on the female segment 210*b* are such that the first conductive ring 216*a* and the second conductive ring 216*b* axially align (with respect to the longitudinal axis 250) with each other when the male segment 210*a* and the female segment 210*b* are mated together. Contact between the first conductive ring 216*a* and the second conductive ring 216*b* establishes an electrical connection between the first wire 220*a* and the second wire 220*b*. Energy, information, or both can be transferred between the first wire 220*a* and the second wire 220*b* through this electrical connection established by the swivel 200.

In some implementations, the first conductive ring 216*a* is rotationally fixed relative to the male segment 210*a*, and the second conductive ring 216*b* is rotationally fixed relative to the female segment 210*b*. The first conductive ring 216*a* and the second conductive ring 216*b* are configured to maintain the electrical connection between the first wire 220*a* and the second wire 220*b* during relative rotational movement of the first conductive ring 216*a* and the second conductive ring 216*b*. As long as the first conductive ring 216*a* and the second conductive ring 216*b* are in contact with each other, electrical connection between the first wire 220*a* coupled to the first conductive ring 216*a* and the second wire 220*b* coupled to the second conductive ring 216*b* is maintained. In some implementations, when the male segment 210*a* and the female segment 210*b* are mated together, the electrical insulator surrounding the first conductive ring 216*a* (for example, rubber) and the electrical insulator surrounding the second conductive ring 216*b* (for example, rubber) compress the first conductive ring 216*a* and the second conductive ring 216*b* toward each other, such that contact between the first conductive ring 216*a* and the second conductive ring 216*b* is maintained.

In some implementations, the surfaces of the first conductive ring 216*a* and the second conductive ring 216*b* that are in contact with each other are polished to mitigate friction generation during relative rotational movement of the first conductive ring 216*a* and the second conductive ring 216*b*. In some implementations, the relative rotational movement of the first conductive ring 216*a* and the second conductive ring 216*b* is limited to rotational speeds less than about 10 revolutions per minute (rpm). In some implementations, the relative rotational movement of the first conductive ring 216*a* and the second conductive ring 216*b* is limited to rotational speeds less than about 5 rpm. Circulation of fluid such as drilling fluid (for example, through an inner bore of the swivel 200, across an external surface of the swivel 200, or both) can facilitate heat dissipation.

In some implementations, the lock pin 218 is configured to pass through the passageway 214*b* of the female segment 210*b* and engage with the groove 214*a* of the male segment 210*a* to prevent relative axial movement of the male segment 210*a* and the female segment 210*b* while allowing relative rotational movement of the male segment 210*a* and the female segment 210*b*. The groove 214*a* can span the entirety of the outer circumferential surface 212*a* of the male segment 210*a* so that relative rotational movement of the male segment 210*a* and the female segment 210*b* is unrestricted. In some implementations, the lock pin 218 is rotationally fixed relative to the female segment 210*b*. In some implementations, the lock pin 218 and the passageway 214*b* of the female segment 210*b* are threaded. Although shown in FIGS. 2C and 2D as having one lock pin 218, the swivel 200 can include additional lock pins 218.

In some implementations, the configuration of the lock pin 218, groove 214*a*, and passageway 214*b* are switched between the male segment 210*a* and the female segment 210*b*. In such implementations, the groove 214*a* can instead be defined by the inner circumferential surface 212*b* of the female segment 210*b*, and the passageway 214*b* can be defined by the male segment 210*a*. The lock pin 218 can be configured to pass through the passageway 214*b* of the male segment 210*a* and engage with the groove 214*a* of the female segment 210*b* to prevent relative axial movement of the male segment 210*a* and the female segment 210*b* while allowing relative rotational movement of the male segment 210*a* and the female segment 210*b*. The groove 214*a* can span the entirety of the inner circumferential surface 212*b* of the female segment 210*b* so that relative rotational movement of the male segment 210*a* and the female segment 210*b* is unrestricted. In some implementations, the lock pin 218 is rotationally fixed relative to the male segment 210*a*. In some implementations, the lock pin 218 and the passageway 214*b* of the male segment 210*a* are threaded.

The swivel 200 can include a first seal 219*a* and a second seal 219*b*, each positioned between the male segment 210*a* and the female segment 210*b*. The first seal 219*a*, the second seal 219*b*, the outer circumferential surface 212*a* of the male segment 210*a*, and the inner circumferential surface 212*b* of the female segment 210*b* together define an inner volume between the male segment 210*a* and the female segment 210*b*. The first conductive ring 216*a* and the second conductive ring 216*b* can be axially positioned (with respect to the longitudinal axis 250) between the first seal 219*a* and the second seal 219*b*, such that the first conductive ring 216*a* and the second conductive ring 216*b* are electrically isolated from a remaining portion of the swivel 200 and fluidically isolated from fluids external to the inner volume. Each of the first seal 219*a* and the second seal 219*b* can blocking fluid from entering or exiting radially through the swivel 200 without hindering relative rotational movement of the male and female segments 210*a* and 210*b*. In some implementations, at least one of the first seal 219*a* or the second seal 219*b* is disposed on an axial surface of the male segment 210*a* or the female segment 210*b*. In some implementations, each of the first seal 219*a* and the second seal 219*b* include a self-lubricated O-ring or a metal-to-metal seal.

Although shown in FIGS. 2C and 2D as having one pair of conductive rings (216*a*, 216*b*), the swivel 200 can include additional pairs of conductive rings to connect additional pairs of wires through the swivel 200. For example, a third wire disposed within the first drill pipe 150*a* can be connected to a third conductive ring disposed on the outer circumferential surface 212*a* of the male segment 210*a*, a fourth wire disposed within the second drill pipe 150*b* can be connected to a fourth conductive ring disposed on the inner circumferential surface 212*b* of the female segment 210*b*, and the third and fourth wires can be connected to each other through contact between the third and fourth conductive rings.

Although shown in FIGS. 2C and 2D as having the lock pin 218 axially positioned in closer proximity to the first drill pipe 220*a* than the pair of conductive rings 216*a* and 216*b*, implementations of the swivel 200 can be such that the axial positions of these components are switched. The order of axial positions of these components (and any duplicates of these components) is not significant (that is, any order is acceptable), as long as these components are sandwiched between the pair of seals 219*a* and 219*b*, such that electric and fluidic isolation of these components are preserved. Although shown in FIGS. 2C and 2D as having one pair of seals (219*a*, 219*b*), the swivel 200 can include additional seals in between any of these components, sandwiching these components, or both. In implementations with additional pairs of conductive rings connecting additional pairs of wires through the swivel 200, the swivel 200 can include additional seals that sandwich one or more of the additional pairs of conductive rings.

Figure 3:
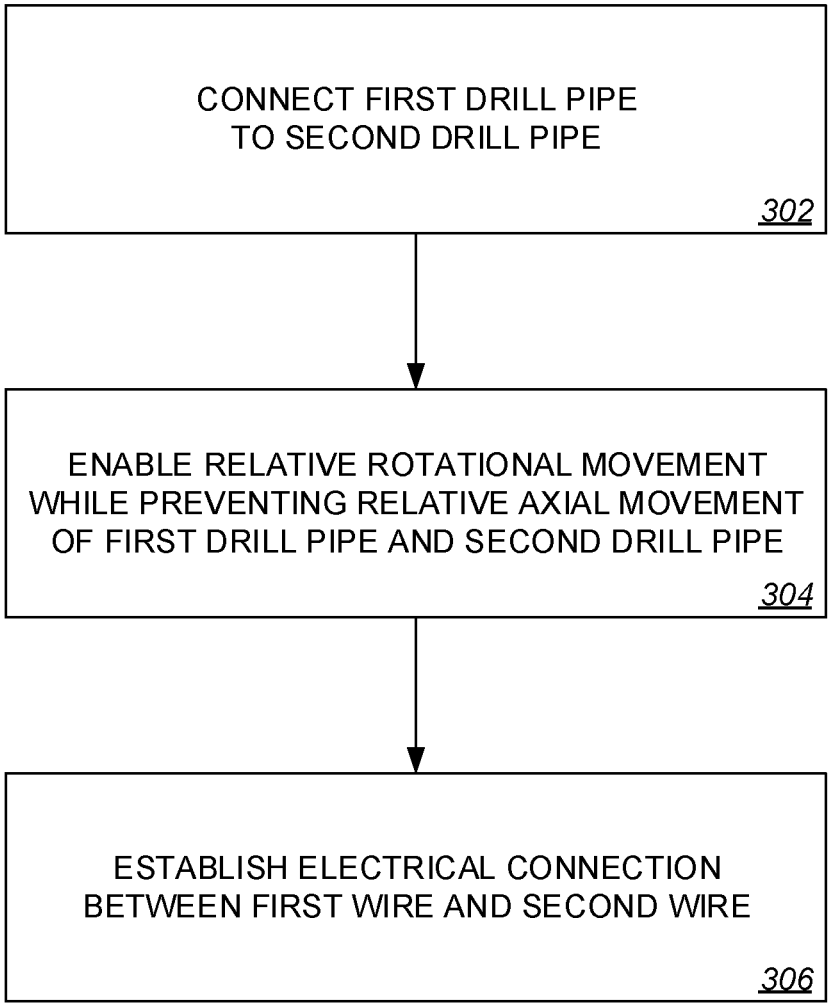
FIG. 3 is a flow chart of an example method for using the example swivel.

FIG. 3 is a flow chart of a method 300 for using the swivel 200. At step 302, connecting a first drill pipe (for example, the first drill pipe 150*a*) to a second drill pipe (for example, the second drill pipe 150*b*) with the swivel 200. The swivel 200 can include a first portion connected to the first drill pipe 150*a* (for example, the male segment 210*a*) and a second portion connected to the second drill pipe 150*b* (for example, the female segment 210*b*).

At step 304, relative rotational movement of the first drill pipe 150*a* and the second drill pipe 150*b* is enabled by the swivel 200, while relative axial movement of the first drill pipe 150*a* and the second drill pipe 150*b* is prevented by the swivel 200. As described previously, the male segment 210*a* can define a groove 214*a*, and the female segment 210*b* can define a passageway 214*b*. In some implementations, the male segment 210*a* defines the passageway 214*b*, and the female segment 210*b* defines the groove 214*a*. The swivel 200 can include a lock pin 218 that passes through the passageway 214*b* and engages with the groove 214*a* to prevent the relative axial movement while allowing relative rotational movement of the first drill pipe 150*a* and the second drill pipe 150*b* at step 304.

At step 306, an electrical connection is established by the swivel 200 between a first wire disposed within the first drill pipe 150*a* (for example, the first wire 220*a*) and a second wire disposed within the second drill pipe 150*b* (for example, the second wire 220*b*). Energy, information, or both can be transferred between the first wire 220*a* and the second wire 220*b* through the swivel 200 due to the electrical connection established by the swivel 200. As described previously, the male segment 210*a* can include a first conductive ring 216*a* that can be connected to the first wire 220*a*, and the female segment 210*b* can include a second conductive ring 216*b* that can be connected to the second wire 220*b*. The electrical connection between the first wire 220*a* and the second wire 220*b* can be established at step 306 by establishing contact between the first conductive ring 216*a* and the second conductive ring 216*b*. Contact can be established between the first conductive ring 216*a* and the second conductive ring 216*b* by mating the male segment 210*a* and the female segment 210*b* with each other. Contact between the first conductive ring 216*a* and the second conductive ring 216*b* can be maintained by the lock pin 218, which can hold the male segment 210*a* and the female segment 210*b* together during operation and relative rotational movement. The first conductive ring 216*a* and the second conductive ring 216*b* can continuously be in contact with one another during relative rotational movement of the first conductive ring 216*a* and the second conductive ring

216*b*. Therefore, the electrical connection between the first wire 220*a* and the second wire 220*b* can be maintained during relative rotational movement of the first conductive ring 216*a* and the second conductive ring 216*b*.

As described previously, the swivel 200 can include a first seal 219*a* and a second seal 219*b*, which are both positioned between the male segment 210*a* and the female segment 210*b*. The first seal 219*a*, the second seal 219*b*, the male segment 210*a*, and the female segment 210*b* can define an inner volume between the male segment 210*a* and the female segment 210*b*. The first conductive ring 216*a* and the second conductive ring 216*b* can be isolated within the inner volume by the first seal 219*a* and the second seal 219*b*.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

As used in this disclosure, the term "about" or "approximately" can allow for a degree of variability in a value or range, for example, within 10%, within 5%, or within 1% of a stated value or of a stated limit of a range.

As used in this disclosure, the term "substantially" refers to a majority of, or mostly, as in at least about 50%, 60%, 70%, 80%, 90%, 95%, 96%, 97%, 98%, 99%, 99.5%, 99.9%, 99.99%, or at least about 99.999% or more.

Values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "0.1% to about 5%" or "0.1% to 5%" should be interpreted to include about 0.1% to about 5%, as well as the individual values (for example, 1%, 2%, 3%, and 4%) and the sub-ranges (for example, 0.1% to 0.5%, 1.1% to 2.2%, 3.3% to 4.4%) within the indicated range. The statement "X to Y" has the same meaning as "about X to about Y," unless indicated otherwise. Likewise, the statement "X, Y, or Z" has the same meaning as "about X, about Y, or about Z," unless indicated otherwise.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described components and systems can generally be integrated together or packaged into multiple products.

Accordingly, the previously described example implementations do not define or constrain the present disclosure. Other changes, substitutions, and alterations are also possible without departing from the spirit and scope of the present disclosure.

What is claimed is:

1. A swivel comprising:

a male segment configured to couple to a first drill pipe of a drill string configured to form a wellbore in a subterranean formation, the male segment comprising:

an outer circumferential surface defining a groove; and a first conductive ring disposed on the outer circumferential surface, the first conductive ring configured to couple to a first wire disposed within the first drill pipe;

a female segment configured to couple to a second drill pipe of the drill string, the female segment defining a passageway, the female segment comprising:

an inner circumferential surface configured to mate with the outer circumferential surface of the male segment; and a second conductive ring disposed on the inner circumferential surface, the second conductive ring configured to couple to a second wire disposed within the second drill pipe, the second conductive ring configured to contact the first conductive ring when the inner circumferential surface of the female segment mates with the outer circumferential surface of the male segment to establish an electrical connection between the first wire and the second wire; and a lock pin configured to pass through the passageway of the female segment and engage with the groove of the male segment to prevent relative axial movement of the male segment and the female segment while allowing relative rotational movement of the male segment and the female segment.

2. The swivel of claim 1, comprising a first seal and a second seal positioned between the male segment and the female segment, wherein the first seal, the second seal, the outer circumferential surface of the male segment, and the inner circumferential surface of the female segment together define an inner volume between the male segment and the female segment.

3. The swivel of claim 2, wherein the first conductive ring and the second conductive ring are axially positioned, relative to a longitudinal axis of the swivel, between the first seal and the second seal, such that the first conductive ring and the second conductive ring are electrically isolated from a remaining portion of the swivel and fluidically isolated from fluids external to the inner volume.

4. The swivel of claim 3, wherein the first conductive ring is rotationally fixed relative to the male segment, the second conductive ring is rotationally fixed relative to the female segment, and the first conductive ring and the second conductive ring are configured to maintain the electrical connection between the first wire and the second wire during relative rotational movement of the first conductive ring and the second conductive ring.

5. The swivel of claim 4, wherein the lock pin and the passageway of the female segment are threaded.

6. The swivel of claim 5, wherein each of the first seal and the second seal comprise a self-lubricated O-ring.

7. A system comprising:

a first drill pipe configured to be disposed within a subterranean formation;

a first wire configured to be disposed within the first drill pipe;

a second drill pipe configured to be disposed within the subterranean formation;

a second wire configured to be disposed within the second drill pipe; and a swivel connecting the first drill pipe to the second drill pipe and the first wire to the second wire, the swivel comprising:

a male segment connected to the first drill pipe;

a female segment connected to the second drill pipe, the male segment and the female segment configured to mate with each other to establish an electrical connection between the first wire and the second wire; and a lock pin configured to prevent relative axial movement of the male segment and the female segment while allowing relative rotational movement of the male segment and the female segment.

8. The system of claim 7, wherein:

the male segment comprises an outer circumferential surface defining a groove;

the female segment comprises an inner circumferential surface and defines a passageway; and the lock pin is configured to pass through the passageway of the female segment and engage with the groove of the male segment.

9. The system of claim 8, wherein the lock pin and the passageway of the female segment are threaded.

10. The system of claim 7, wherein:

the male segment comprises a first conductive ring connected to the first wire;

the female segment comprises a second conductive ring connected to the second wire; and the first conductive ring of the male segment is configured to contact the second conductive ring of the female segment when the male segment and the female segment mate with each other to establish the electrical connection between the first wire and the second wire.

11. The system of claim 10, wherein the first conductive ring is rotationally fixed relative to the male segment, the second conductive ring is rotationally fixed relative to the female segment, and the first conductive ring and the second conductive ring are configured to maintain the electrical connection between the first wire and the second wire during relative rotational movement of the first conductive ring and the second conductive ring.

12. The system of claim 11, wherein the swivel comprises a first seal and a second seal positioned between the male segment and the female segment, wherein the first seal, the second seal, the male segment, and the female segment together define an inner volume between the male segment and the female segment.

13. The system of claim 12, wherein the first conductive ring and the second conductive ring are axially positioned, relative to a longitudinal axis of the swivel, between the first seal and the second seal, such that the first conductive ring and the second conductive ring are electrically isolated from a remaining portion of the swivel and fluidically isolated from fluids external to the inner volume.

14. The system of claim 13, wherein each of the first seal and the second seal comprise a self-lubricated O-ring.

15. The system of claim 14, wherein at least one of the first seal or the second seal is disposed on an axial surface of the male segment.

16. A method comprising:

connecting, by a swivel, a first drill pipe to a second drill pipe, wherein the swivel comprises:

a first portion connected to the first drill pipe, the first portion defining a groove; and a second portion connected to the second drill pipe and mated with the first portion, the second portion defining a passageway, and connecting the first drill pipe to the second drill pipe comprises passing a lock pin through the passageway of the second portion and engaging the lock pin with the groove of the first portion to secure the first portion to the second portion, and engaging the lock pin with the groove of the first portion prevents the relative axial movement of the first drill pipe and the second drill pipe;

enabling, by the swivel, relative rotational movement of the first drill pipe and the second drill pipe while preventing relative axial movement of the first drill pipe and the second drill pipe; and establishing, by the swivel, an electrical connection between a first wire disposed within the first drill pipe and a second wire disposed within the second drill pipe.

17. The method of claim 16, wherein:

the first portion comprises a first conductive ring connected to the first wire, the second portion comprises a second conductive ring connected to the second wire, and wherein establishing the electrical connection between the first wire and the second wire comprises establishing contact between the first conductive ring and the second conductive ring.

18. The method of claim 17, wherein:

the first conductive ring is rotationally fixed to the first portion;

the second conductive ring is rotationally fixed to the second portion; and the method comprises continuously contacting the first conductive ring to the second conductive ring during relative rotational movement of the first conductive ring and the second conductive ring to maintain the electrical connection between the first wire and the second wire.

19. The method of claim 17, wherein:

the swivel comprises a first seal and a second seal positioned between the first portion and the second portion, the first seal, the second seal, the first portion, and the second portion define an inner volume between the first portion and the second portion, and wherein the method comprises isolating, by the first seal and the second seal, the first conductive ring and the second conductive ring within the inner volume.

* * * * *